United States Patent [19]

Russell

[11] 4,446,914

[45] May 8, 1984

[54] DRY COOLING TOWER

[75] Inventor: Charles M. Russell, Harpenden, England

[73] Assignee: The Lummus Company, Bloomfield, N.J.

[21] Appl. No.: 370,765

[22] Filed: Apr. 22, 1982

[30] Foreign Application Priority Data

Apr. 23, 1981 [GB] United Kingdom ..... 8112658

[51] Int. Cl.[3] ..... F28D 1/04

[52] U.S. Cl. ..... 165/129; 165/125; 165/DIG. 1

[58] Field of Search ..... 165/128, 129, 125, DIG. 1

[56] References Cited

U.S. PATENT DOCUMENTS

| | | | |
|---|---|---|---|
| 3,474,855 | 10/1969 | Caldwell | 165/125 X |
| 3,888,305 | 6/1975 | Gerz | 165/125 X |
| 3,944,636 | 3/1976 | Schuldenberg et al. | 165/129 X |
| 4,020,899 | 5/1977 | Langerock | 165/125 X |

FOREIGN PATENT DOCUMENTS

| | | | |
|---|---|---|---|
| 1172065 | 2/1959 | France | 165/125 |
| 2337323 | 7/1977 | France | 165/DIG. 1 |

*Primary Examiner*—Sheldon J. Richter
*Attorney, Agent, or Firm*—James N. Blauvelt

[57] ABSTRACT

An air cooled dry cooling tower (10) has two sets of heat exchange assemblies (14,15) whose radiator surface (16) (e.g. tubular bundles) is substantially horizontally disposed, generally in the form of two frustra of cones whose axes are on or near the vertical tower center-line, the frustra being placed one on top of the other, in opposite directions, such that a section through the radiator surfaces is V-shaped. The angle of the tubular bundles can be varied to minimize the angle of incidence of the prevailing wind conditions and to avoid excessive fouling of the finned surface of the tubes in the bundles.

17 Claims, 11 Drawing Figures

FIG. 9
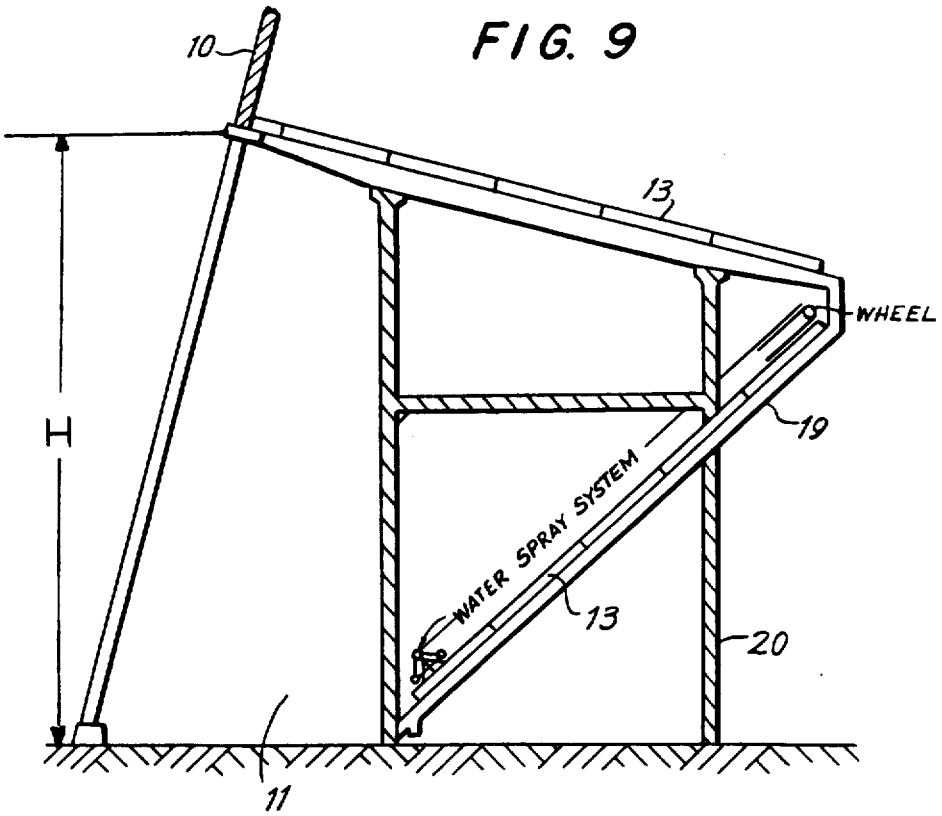
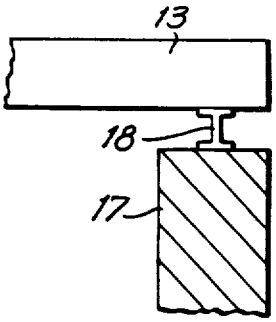
FIG. 10

DRY COOLING TOWER

Dry cooling towers in which a fluid is cooled or condensed by a flow of air induced by natural convection due to its own heating, and in which the air is contained within a shell, are well known. The cooling or condensation of the fluid, takes place within radiator elements which prevent direct contact between fluid and air. The hot fluid may be allowed to circulate in a single battery unit (or heat exchange assembly) of such radiator elements or in a double battery unit, connected, either in series or in parallel, for internal fluid feeding. The tower may be equipped with windscreens to minimize the disturbance caused by strong cross-winds.

Heat exchangers for cooling towers are generally rectangular (parallelipipedic) bundles of smooth, but more preferably of finned, tube batteries joined at their extremities by fluid-feed boxes; and the fluid which circulates form one box to the other is cooled by the cold air which crosses the interstices between the tubes. The material of which the tubes are made may be metal or plastic, but preferably metal, the nature of material selection being dependent upon, and in accordance with, the nature of the warm fluid to be cooled. The air emitted by the tower is generally hot and dry: it consists of air at 40° C. having a relative humidity of 15%.

More specifically, conventional dry cooling towers generally comprise a tower shell having at the periphery of its base an air inlet, a tower lintel which surmounts the air inlet, a chimney mounted on said lintel, and an air outlet from which the hot, dry air is emitted. Generally, these cooling towers are used for the purpose of cooling a fluid, usually the water from steam turbine condensers of electrical or nuclear power plants, or for condensing directly the water vapor originating from the turbines and cooling the hot condensate. The electrical or nuclear power produced is related to the "cooling power" of the tower, i.e., among other things, it is related to the total length of tubes of the heat exchangers, but the efficiency of the exchange of heat depends also on the uniformity of passage of the air through the heat exchangers. The establishment and maintenance of optimum conditions pose extremely difficult and complex problems with regard to the dimensions of the tower and its components, the arrangement of the batteries, and the means to minimize the harmful effects of the wind on the heat exchangers.

As discussed in U.S. Pat. No. 4,020,899, which contains a summary of the prior art in this regard, various means have been employed to minimize the effect of winds and to control the amount and profile of the cold air introduced into the tower. Such known means have included, e.g., (1) the placement of mobile, adjustable panels at the base of the tower to control the external wind's direction and intensity; (2) the introduction of substantially horizontal, or horizontal, radiator units in the tower chimney along its lintel; and (3) the use of air deflectors or partitions, or of stepped, ascending or descending radiator units to regularize the cold air profile without compromising the draft of the chimney. In particular, the inventive essence of this U.S. patent consists of prescribing the use of a double battery unit consisting of a first set of dry-type heat exchange assemblies mounted in a vertical array on a circle within the tower and concentric to the wall of the tower housing and a second set of such heat exchange assemblies mounted horizontally, extending from the first set to the wall of the tower housing.

The tower design proposed by this U.S. patent, however, is not without difficulties of its own. For example, since such design specifically mandates that some of its radiator tubes or elements, which are customarily finned, have to be vertically disposed with the fins horizontal, it is inevitable that water and sediment will collect on them, thereby leading to corrosion and consequent reduction in heat transfer effectiveness. Even more importantly, the arrangement of the conventional rectangular tubular bundles of which the two battery units or heat exchanger assemblies are composed is not a design that make effective use of space. This deficiency is heightened in that there are concomitant losses of efficiencies in cooling associated with such ineffective uses of tower space. For example, when tubular bundles are arranged in accordance with the teachings of this U.S. patent, the rigidity of their arrangement restricts the number of options by which they can be efficiently installed into the cooling tower; it also limits the choices in bundle dimensions and consequently the tower dimensions. This is why in the past dry cooling towers have often been characterized by having uneconomic designs and inappropriate dimensions. For example, tubular bundles arranged in the form of deltas or half deltas (i.e., deltas separated into two halves by sheeting or dividers) which are equipped with air shields cannot extend beyond a certain length radially, since the apex angle decrease as the bundle extends toward the center of the tower. This progressively restricts more and more of the air flow through the bundles as it proceeds toward the center of the tower. Also the efficiency with which the interior space of the cooling tower can be filled with tubular bundles decreases as the placement of bundles extends towards the center of the tower. Therefore, even though one can theoretically decrease the apex angle at the start of filling the tower with tubular bundles os as to accommodate more bundles, to do so, as a practical matter, would only aggravate the situation in that the consequent increase in pressure drop would result in an uneconomical tower design and undesirable tower dimensions. In the case of the tower design disclosed in U.S. Pat. No. 4,020,899, moreover, the combined horizontal-vertical bundle arrangement is subject to an additional deficiency or disadvantage in that the vertical moieties of such arrangement in their finned embodiments are prone to rapid fouling of the fins, which reduces the effectiveness of such embodiments. This, in turn, would alter or diminish the air flow and its passage through the tower, and result in the need for the installation of costly cleaning devices and increased tower dimensions which would make the tower uneconomical.

Moreover, notwithstanding all that this patent has to say about achieving an ideal cold air flow profile into the tower and through its chimney, it is unable to achieve the maximum operating results in this regard, in large measure for reasons already advanced but also in part due to the relative lack of attention it pays to the factor of the incoming cold air and its deflection and deployment through the chimney of the tower.

It is a major emphasis of the present invention to address itself to these problems and appreciably ameliorate or otherwise resolve them. This is done essentially through the employment, within the air inlet of the tower, of a novel arrangement of heat exchange assemblies comprising a plurality of heat exchange assemblies or battery units, preferably in the form of an upper and lower set of such heat exchange assemblies whose radiator surface is substantially horizontally disposed, as will be hereinafter discussed. It has been found, for example, in this invention, particularly as and when it relates to a cylindrical, hyperbolic, or flared tower, that the arrangement of the heat exchange assemblies in the manner described herein provides the tower with better packing of such heat exchange assemblies and therefore increased tower efficiency for a give tower size. It also enables excessive fouling to be avoided of the finned surface of the tube bundles that comprise the heat exchange assemblies. Accordingly, the dry cooling tower of the present invention is characterized by having a superior economic design, favorable dimensions, and superior air flow conditions through the present, substantially horizontally disposed heat exchange assemblies. The expression "substantially horizontally disposed" is intended to embrace and cover the critical relationship (including the mathematical definition thereof), that has been found to exist between the height of the air inlet and the longest length of the tubular bundles (of the heat exchange assemblies) lying along a surface concentric to the circumference of the tower, or radially within the tower. This critical relationship can more clearly be seen with reference to FIG. 11, where:

H=the height of the air inlet, $F_1$=the length of the longest side of the upper cone frustrum, and $F_2$=the length of the longest side of the lower cone frustrum.

Thus, in accordance with this relationship, it can be seen that: $H=F_1 \sin \theta+F_2 \sin \alpha$. However, it has been found that, in order to achieve good air flow through the tower, H must be greater than 0.8 $F_1$ and less than 1.3 $F_2$. Furthermore, it has been found that angle $\theta$ must range from about 5° to about 45° and that angle $\alpha$ must range from about 20° to about 60°, it being noted that, as each of these angles increases to the horizontal, the desirability of using vertical fins increases so as to reduce the corrosion and fouling problems that can occur when the heat exchanger assemblies are horizontally disposed. However, it has also been noted that if and when angle $\theta$=angle $\alpha$, these results a restriction of air flow below $F_2$, which requires lowering of the ground level beneath the tower in order to correct this deficiency, so that the air escape mass velocity will be approximately equal to the velocity under the tower lintel. On the other hand, if angle $\alpha$ is greater than angle $\theta$, so that the mass velocity of the air escaping is approximately equal to the mass velocity of the air under the lintel, it is not necessary to have to lower the ground level.

In general, it is not preferable for angle $\theta$ to be at the lower end of its range, because this would require angle $\alpha$ to be at the upper end of its range and thus require $F_2$ to be much longer in length than $F_1$. For example, when angle $\theta$ is about 5°, angle $\alpha$ has to be about 60° in order to satisfy the requirements of this invention. As can therefore be seen, the most preferred values for angles $\theta$ and $\alpha$ are those which result in the lengths of $F_1$ and $F_2$ being equal or substantially the same, as would be the case when angle $\theta$ is from about 40° to about 43° and angle $\alpha$ is from about 27° to about 32°.

It is well known in the art of air coolers that the air flow into and out of the radiator surface should be uniform and evenly distributed over all its area.

It has been found that the parasitic losses associated with the air inlet and outlet from the upper set of heat exchange assemblies are very small and that, in order to insure that there are good flow conditions for the air leaving the lower set of heat exchange assemblies, the ratio of the length $F_2$ of the radiator surface of the lower set of heat exchange assemblies to the diameter of the tower at the level of its lintel must be such that $F_2$ not exceed such diameter by a percentage factor, arising out of the relationships defined by the above equation and ranges of values prescribed for angles $\alpha$ and $\theta$ and for H in terms of $F_1$ and $F_2$. In a preferred embodiment of this invention, this length ($F_2$) should not be greater than 18% of the diameter of the tower at the top of the air inlet, otherwise excessive air velocities, associated with high parasitic losses, will occur in the air flow leaving the lower set of heat exchange assemblies.

Furthermore, in order to insure that the maximum amount of radiator surface is fitted into the lower, in conformity with the present invention, the ratio of the length of the radiator surface $F_2$ to the tower diameter at the level of its lintel must be such that $F_2$ is greater than a certain percentage of such diameter, which, in a preferred embodiment of this invention, is more than 8% of the tower diameter.

In accordance, therefore, with the present invention, there is provided a cooling tower, comprising a hollow tower open at the upper end for the discharge of heated air, an air inlet for introducing air at the lower peripheral wall of the tower, and a plurality of heat exchange assemblies mounted within the tower comprising a lower set of heat exchangers comprisng heat exchange surfaces positioned in a substantially horizontally extending array about the air inlet on a circle concentric to the peripheral wall of the tower and an upper set of heat exchangers adjoining said lower set of exchangers comprising heat exchange surfaces positioned in a substantially horizontal plane and extending above the tops of said lower set of heat exchangers in the annular air passage between said tops and the wall of said hollow tower, the upper set of heat exchangers extending downwardly from the upper end of the air inlet of the tower to define an angle $\theta$ to the horizontal, the lower set of heat exchangers extending in a direction downwardly from said upper set toward the ground to define an angle $\alpha$ with the horizontal or the ground, and the relationship between the height of the air inlet (H) and the length ($F_1$) of the longest side of the heat exchange surface of said upper set of heat exchangers and the length ($F_2$) of the longest side of the heat exchange surface of said lower set of heat exchangers being defined by the equation: $H=F_1 \sin \theta+F_2 \sin \alpha$ where H must be greater than $0.8F_1$ and less than $1.3F_2$, angle $\theta$ ranging from about 5° to about 45° and angle $\alpha$ ranging from about 20° to about 60°.

The tubular bundles that form the heat exchange assemblies of the present invention (e.g. the upper and lower batteries or assemblies) are arranged, as noted, adjoining each other (i.e., (a) are either close to each other but not in direct contact, or (b) are in direct contact) in two substantially horizontal planes (whose relationship conforms with the equation and critical limits set forth above) and placed in a manner so as to form flat batteries, thereby attaining the ideal air stream potentials for uniform operation. It is not essential or required that the upper and lower heat exchange assemblies be in actual direct contact with each other; all that is necessary is that their promimity to each other be sufficiently close as to enable them to have a common header, thereby enabling fluid to be circulated from one assembly to the other. As previously noted, circulation of fluid between the two heat exchange assemblies can be effected in either of two ways: for example, it can proceed via parallel flow where the tubular bundles of which such assemblies are constituted are in parallel operation; alternatively, it can proceed via series flow; however, in this case, the upper and lower heat exchange assemblies are in series and have to be connected, i.e. be in direct contact with each other.

The bundles are placed with the longest part thereof lying along the outer periphery or circumference of the Tower so as to enable the tube length to be varied proportionately with the distance to the center of the tower. Alternatively, the bundles can be arranged with the longest part thereof situated radially so as to maximize the tower capacity in terms of its ability to contain heat exchange elements and in terms of its flexibility to accommodate bundles of varying lengths. In still another alternative-embodiment, the bundles can be arranged in the form of deltas, such that the angle of the delta formed by the tubular bundles is restricted to minimize additional pressure losses.

The angle of the bundles to the horizontal can be varied so as to minimize the angle of incidence of the prevailing wind conditions.

It is preferred, however, that both upper and lower battery units or heat exchanger assemblies of the present invention be connected in parallel for internal fluid feeding and that the natural draft of the chimney be aided, as needed, either by ventilators blowing atmospheric air across such units or assemblies, or by ventilators sucking atmospheric air across such units or assemblies for the purpose of avoiding direct sound radiation of the ventilators in the vicinity of the cooler.

The invention may be more fully understood by reference to the accompanying drawings wherein:

FIG. 9 is a partial section in elevation showing, e.g., a parallel internal feeding unit and exemplary structural means for supporting the upper heat exchange assembly; and FIG. 10 is a schematic view showing an exemplary basis for supporting the tubular bundles.

Figure 1:
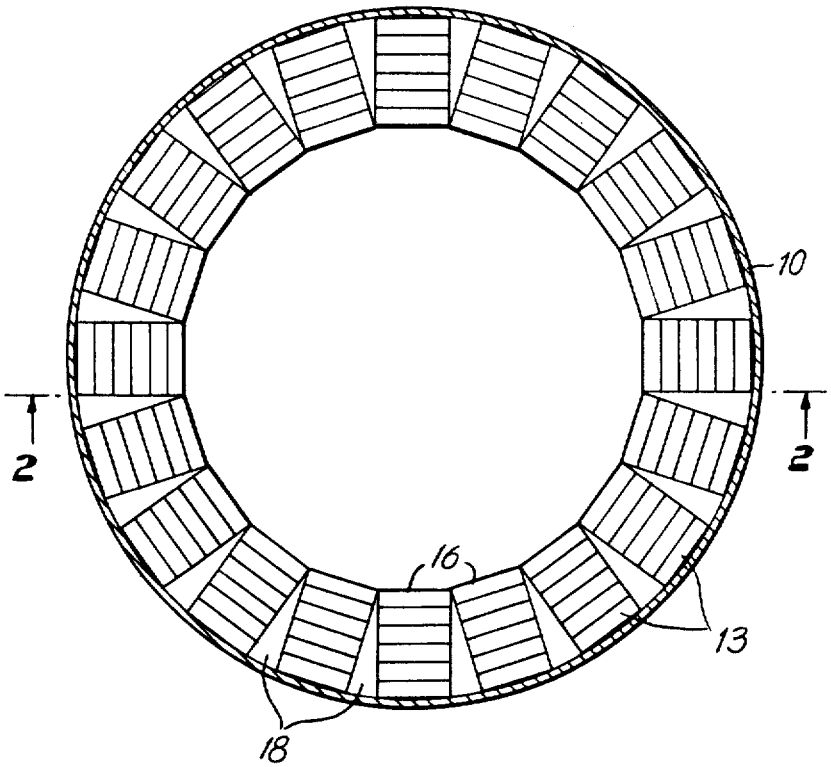
FIG. 1 is a plan view of the tower of this invention, showing the heat exchange assemblies thereof to be circumferentially arranged and substantially horizontally disposed in the form of bundles of equal length.
Figure 2:
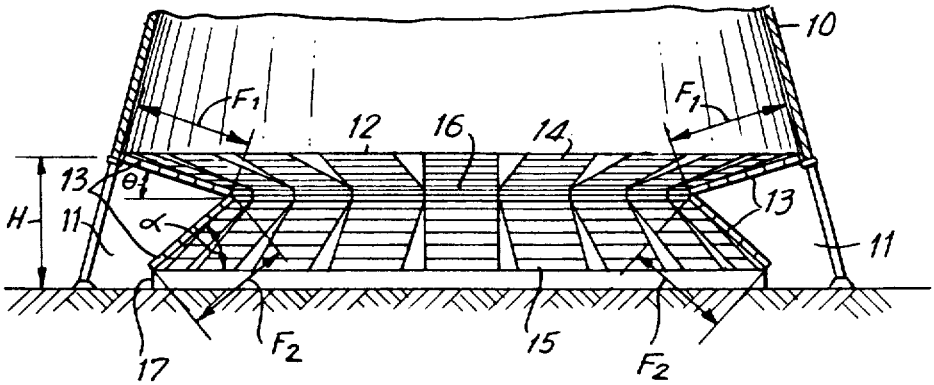
FIG. 2 is a partial section in elevation of the embodiment of the invention depicted in FIG. 1, along line 2—2 of FIG. 1.
Figure 3:
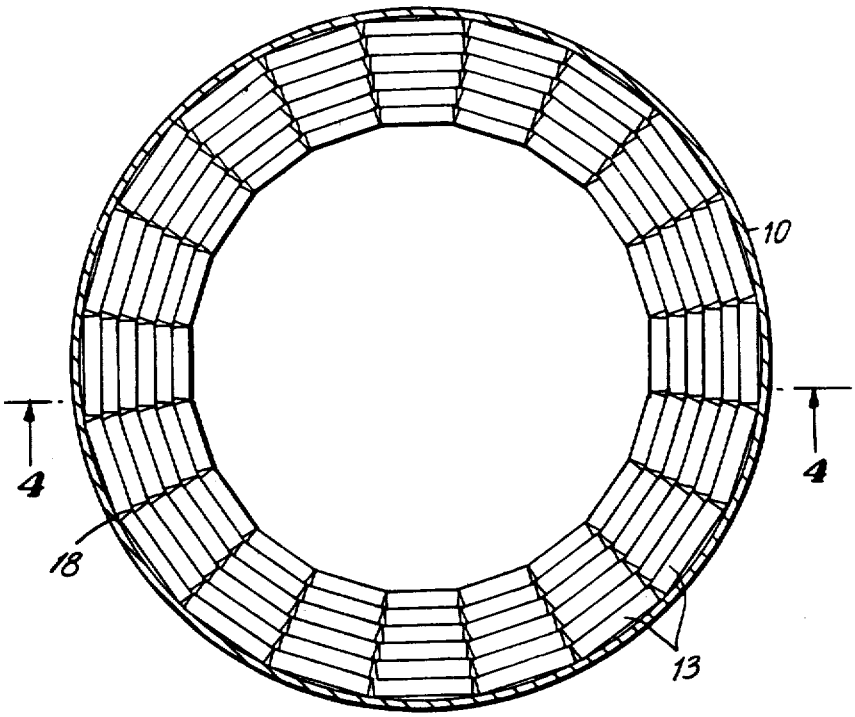
FIG. 3 is a plan view of the present tower showing the heat exchange assemblies thereof to be circumferentially arranged and substantially horizontally disposed in the form of bundles of unequal length.
Figure 4:
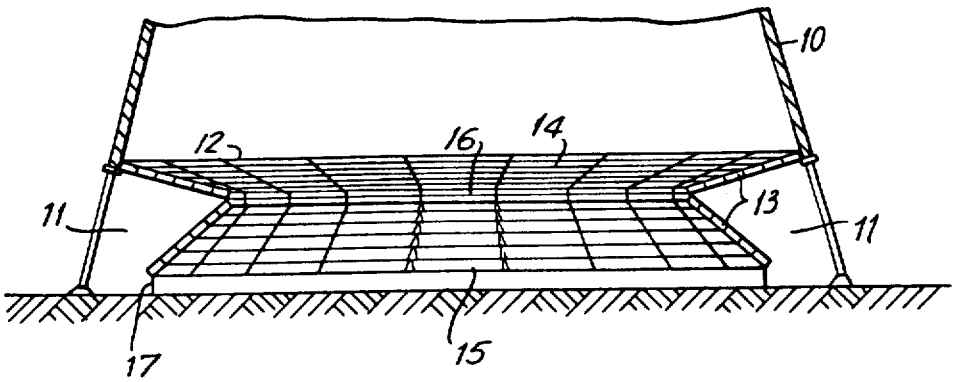
FIG. 4 is a partial section in elevation of the embodiment of the invention depicted in FIG. 3.
Figure 5:
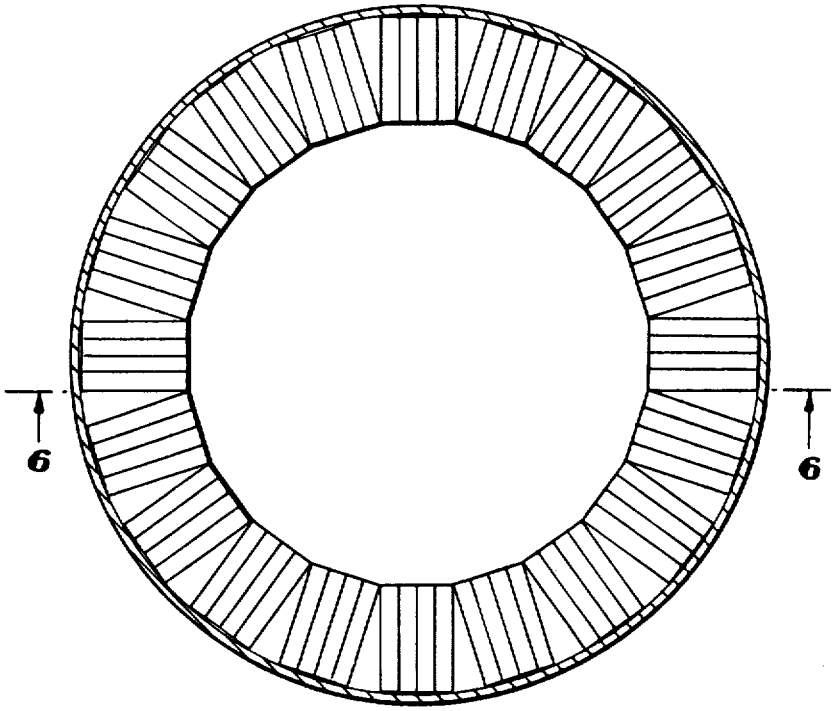
FIG. 5 is a plan view of the tower of this invention showing the heat exchange assemblies thereof to be radially arranged and substantially horizontally disposed in the form of bundles of equal length.
Figure 6:
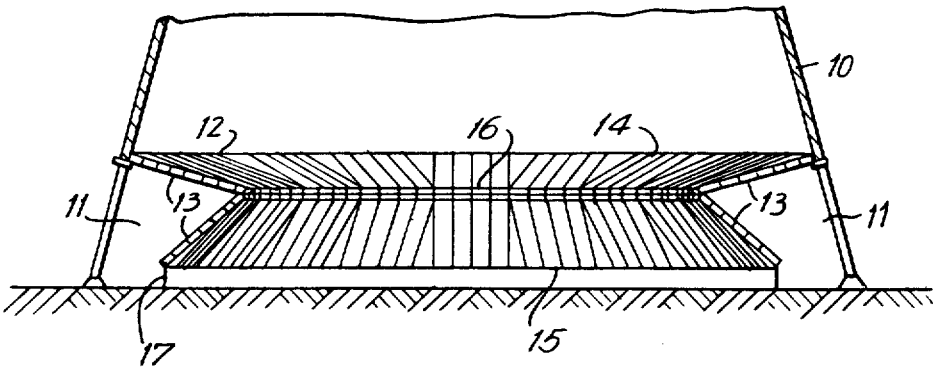
FIG. 6 is a partial section in elevation of the embodiment of the invention depicted in FIG. 5.
Figure 7:
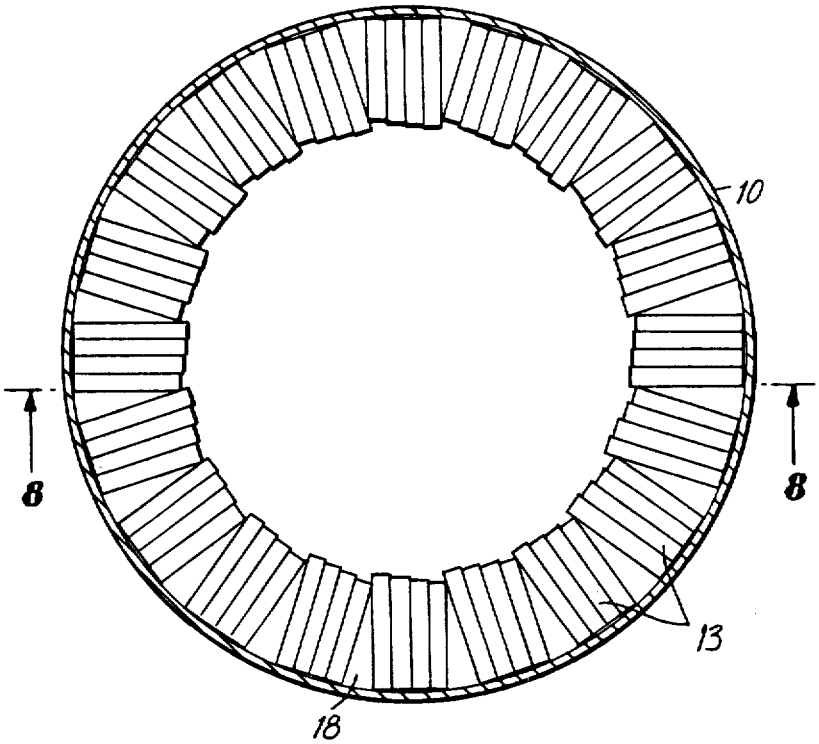
FIG. 7 is a plan view of the present tower, showing the heat exchange assemblies thereof to be radially arranged and substantially horizontally disposed in the form of bundles of uneven length.
Figure 8:
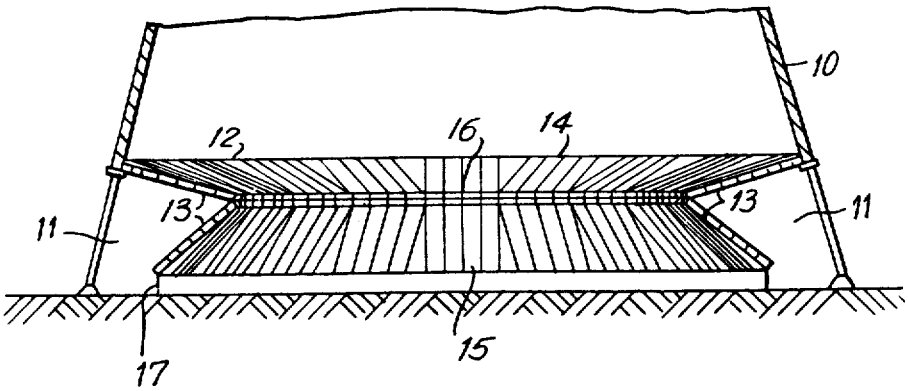
FIG. 8 is a partial section in elevation of the embodiment of the invention depicted in FIG. 7.

Referring now to the drawings, particularly to FIGS. 1, 2, 9, 10 and 11, where reference numerals have been assigned the main apparatus elements of the present invention, there is shown a hollow cooling tower in the form of a natural draft cylindrical cooling tower 10 having a peripheral air inlet 11 around the base of the tower through which cooling air flows, by natural draft, from the surrounding atmosphere. It is to be understood that the tower could be of the forced air type or could be a natural draft tower with a shape other than cylindrical, i.e., hyperbolic or flared, for example.

Figure 11:
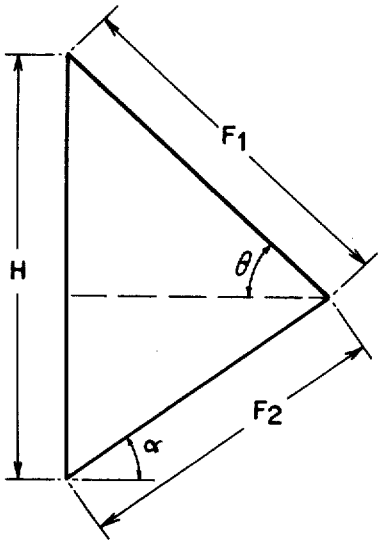
FIG. 11 is a diagram depicting the critical relationship between the height of the air inlet and the lengths of the tubular bundles (of the heat exchange assemblies) discussed above.

The height of the annular air inlet, denoted by H, defines the distance between (a) the upper end of the air inlet, generally coextensive with the tower chimney lintel 12, and (b) the ground level. Mounted between the lintel and the ground extending beneath the site of the tower 10 is a plurality of heat exchangers generally designated 13, comprising an upper assembly 14 and a lower assembly 15. Each of these assemblies has a heat exchange surface in the form of tubular bundles having a plurality of tubes 16, and such assemblies are arranged, as shown in FIG. 11 discussed above, and in FIG. 2 such that $H=F_1 \sin \theta + F_2 \sin \alpha$. However, as previously noted, H must range between values of $>0.8$ $F_1$ and $<1.3$ $F_2$ to achieve good air flow; angle $\theta$ must not exceed 45° to avoid excess fouling of the finned surfaces of heat exchangers 13; and angle $\alpha$ must not be less than 20° so as to ensure that good air flow conditions into the tower exist.

As known in the art, the tubes 16 in each exchanger are suitably arranged to permit air flow through the interstices between the tubes, whereby fluid flowing through the tubes is cooled by such air flow.

The heat exchanger assemblies 13 are conveniently supported by concrete pillars or like means known to the art generally designated 17, and such assemblies are joined at their extremities by fluid-feed boxes (not shown) so that the fluid which circulates form one box to the other is cooled by the cold air crossing the interstices between the tubes, as described above. This fluid circulation system, however, is conventional in nature; and it is intended to include for use in the present invention any of the usual fluid circulation systems practiced in and by the art.

Between each of the heat exchange assemblies 13 is sheeting 18 to keep them separate and apart.

Consistent with the arrangement and deployment of the tubular bundles that comprise the heat exchange assemblies of the present tower, many variations are possible with respect to the dimensions of such bundles: e.g., the tube length and bundle height are susceptible to considerable variation within the practice of this invention.

Thus, the tubes can be either of equal or unequal length, and the overall geometry for arranging the heat exchanger surfaces can vary, e.g. so as to provide a hyperbolic bundle geometry, a single level bundle geometry, and the like.

In FIG. 9, there is shown a preferred embodiment of the present invention wherein a parallel flow, circulatingg fluid system 19 is depicted and a supporting structure 20 is shown, in the form of an "H"; for the upper heat exchange assembly. Also shown, for purposes of illustration, is a chain-driven, water spray system which is an optional apparatus within the purview of this invention and may be used for purposes of cleaning the lower heat exchange assembly, thereby removing sediment that may have accumulated there.

In FIG. 10, there is shown an exemplary means by which the concrete pillars or like means support the lower heat exchange assemblies of this invention. For the sake of convenience, the heat exchangers 13 have been shown in a horizontal configuration, supported by an I-beam 21, but it is to be understood that they could just as readily have been depicted in an alternative form within the purview of this invention, such as in the form of a substantially horizontal configuration, and with the use of alternative support means for the heat exchangers.

It is also to be understood that numerous modifications and variations of the present invention are possible in light of the above teachings and therefore are within the scope of the claims defining this invention and the various ways and means in and by which it can be practiced otherwise than as particularly described herein.

What is claimed is:

1. A cooling tower comprising a hollow tower open at the upper end for the discharge of heated air, an air inlet for introducing air at the lower peripheral wall of the tower, and a plurality of heat exchange assemblies mounted within the tower comprising a lower set of heat exchangers comprising heat exchange surfaces positioned in a substantially horizontally extending array about the air inlet on a circle concentric to the peripheral wall of the tower and an upper set of heat exchangers adjoining said lower set of heat exchangers comprising heat exchange surfaces positioned in a substantially horizontal plane and extending above the tops of said lower set of heat exchangers in the annular air passage between said tops and the wall of said hollow tower, the configuration of the heat exchange surfaces of said upper and lower sets of heat exchangers being V-shaped, said upper set of heat exchangers extending downwardly from the upper end of the air inlet of the tower to define an angle $\theta$ to the horizontal, said lower set of heat exchangers extending in a direction downwardly from said upper set toward the ground to define an angle $\alpha$ with the horizontal or the ground, and the relationship between the height of the air inlet (H) and the length ($F_1$) of the longest side of the heat exchange surface of said upper set of heat exchangers and the length ($F_2$) of the longest side of the heat exchange surface of said lower set of heat exchangers being defined by the equation: $H=F_1 \sin \theta+F_2 \sin \alpha$ where H must be greater than 0.8 $F_1$ and less than 1.3 $F_2$, angle $\theta$ ranging from about 5° to about 45° and angle $\alpha$ ranging from about 20° to about 60°.

2. A cooling tower according to claim 1, wherein the lower set of heat exchangers is assembled in a configuration defining the frustrum of a cone.

3. A cooling tower according to claim 2, wherein the axis of said cone is on or near vertical axis of said tower.

4. A cooling tower according to claim 1, wherein the upper set of heat exchangers is assembled in a configuration defining the frustrum of a cone.

5. A cooling tower according to claim 4, wherein the axis of the cone of said upper set is on or near the vertical axis of said tower.

6. A cooling tower according to claim 1, wherein the upper set of heat exchangers defines an angle with horizontal of between 40° and 43°.

7. A cooling tower according to claim 1, wherein the lower set of heat exchangers defines an angle with the horizontal of between 20° and 30°.

8. A cooling tower according to claim 1, wherein the heat exchangers of said upper and lower sets are circumferentially arranged within the tower.

9. A cooling tower according to claim 1, wherein the heat exchange surface of said heat exchangers comprises tubes of the same length.

10. A cooling tower according to claim 1, wherein the heat exchange surface of said heat exchangers comprises tubes of different length.

11. A cooling tower according to claim 1, wherein the heat exchangers of said upper and lower sets are radially arranged within the tower.

12. A cooling tower according to claim 1, wherein the heat exchange assemblies are arranged in the form of deltas.

13. A cooling tower according to claim 1, wherein $F_2$ is not greater than 18% of the diameter of the tower at the top of the air inlet.

14. A cooling tower according to claim 1, wherein $F_2$ is greater than 18% of the diameter of the tower at the top of the air inlet.

15. A cooling tower according to claim 1, wherein the lower set of heat exchangers comprises finned tubes whose fins are vertically disposed.

16. A cooling tower according to claim 1, wherein the upper set of heat exchangers comprises finned tubes whose fins are vertically disposed.

17. A cooling tower according to claim 1, additionally comprising a water spray system for cleaning the heat exchange surfaces of said heat exchange assemblies.

* * * * *